United States Patent [19]

England et al.

[11] 4,006,555

[45] Feb. 8, 1977

[54] DOLL WITH INCREMENTALLY MOVABLE ARM

[75] Inventors: Donald E. England; George P. Giordano, both of Cincinnati, Ohio; Garland C. Thompson, Dillsboro, Ind.; James J. Wright, Loveland, Ohio

[73] Assignee: General Mills Fun Group, Inc., Minneapolis, Minn.

[22] Filed: June 11, 1975

[21] Appl. No.: 585,940

[52] U.S. Cl. ..... 46/119; 46/117; 46/165

[51] Int. Cl.[2] ..... A63H 33/00

[58] Field of Search ..... 46/119, 120

[56] References Cited

UNITED STATES PATENTS

| | | | |
|---|---|---|---|
| 2,548,237 | 4/1951 | Pearson | 46/120 |
| 3,587,191 | 6/1971 | Cooper | 46/119 X |
| 3,699,713 | 10/1972 | Sapkus et al. | 46/119 |
| 3,713,252 | 1/1973 | Bear et al. | 46/119 X |
| 3,721,040 | 3/1973 | Goldfarb | 46/119 |

*Primary Examiner*—F. Barry Shay
*Attorney, Agent, or Firm*—G. O. Enockson; L. M. Lillehaugen

[57] ABSTRACT

A doll having a movable head, and articulated appendages movably attached to the doll's torso. An actuator and a gear transmission system are operatively connected to one of the doll's arms, for imparting incremental movement to the arm. The transmission can be placed in gear, or taken out of gear, by manually rotating the doll's head. By placing the transmission in gear and manipulating the actuator, the transmission is activated so that the doll's arm, and if desired, a light load placed in the doll's hand, can be slowly raised to an elevated position. In addition, simulated battery pack inserts are positioned in one arm, a flexible skin-like covering stretchably fits over such arm, and a wide-angle lens is positioned in the doll's head.

20 Claims, 14 Drawing Figures

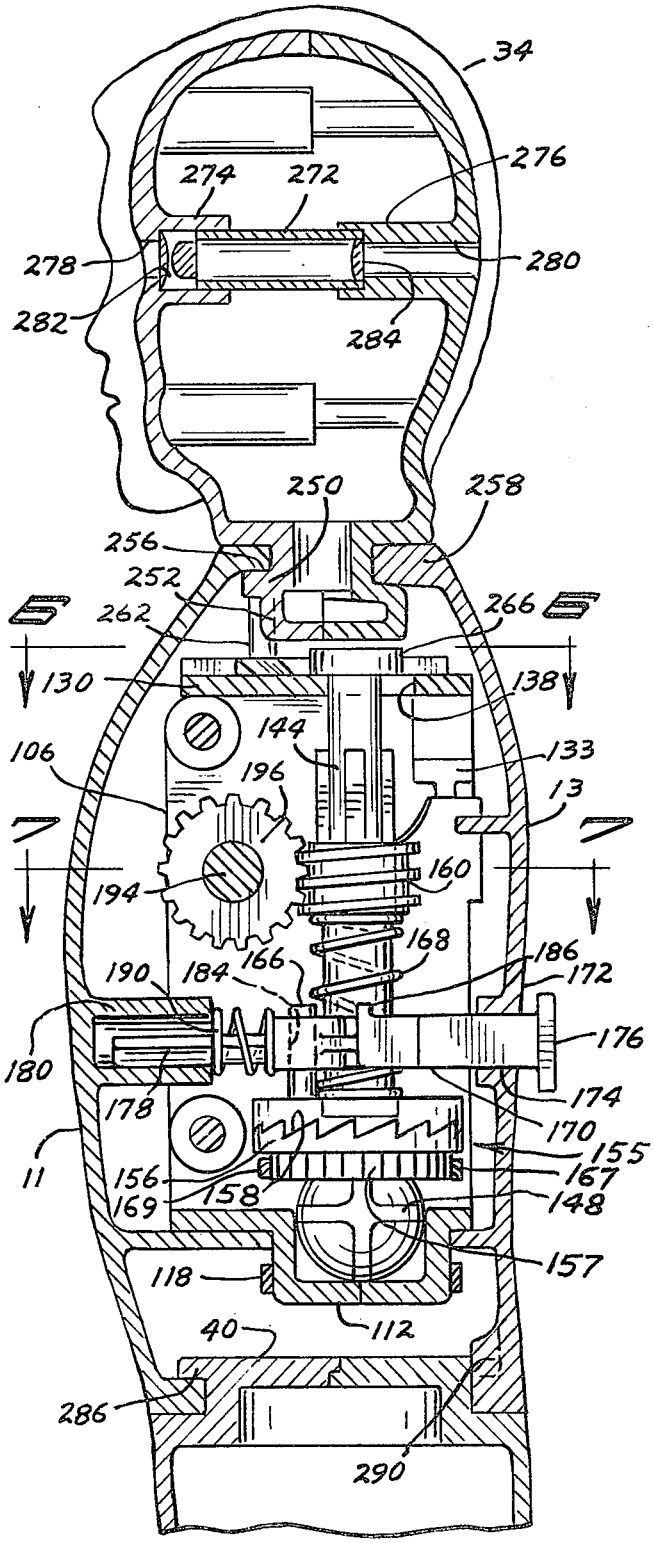
FIG. 5
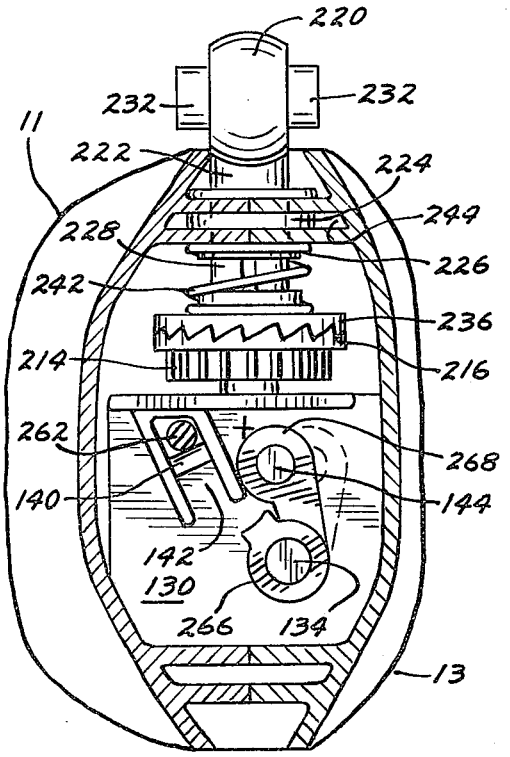
FIG. 6
FIG. 7
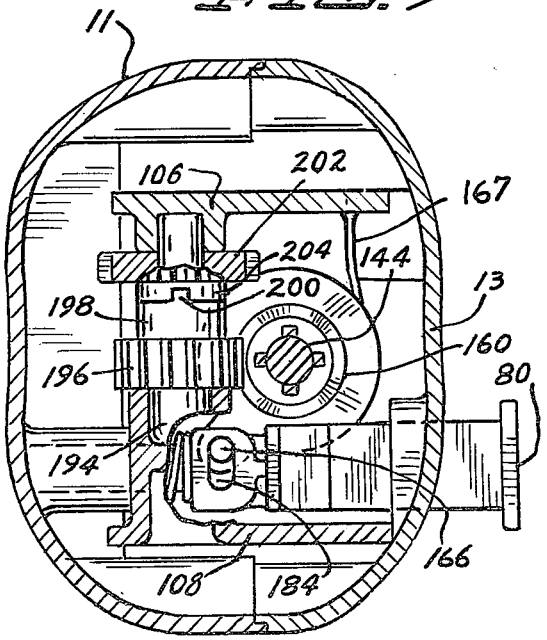

DOLL WITH INCREMENTALLY MOVABLE ARM

The present invention relates to articulated figure toys, and more particularly to an articulated doll having a movable limb capable of performing manual functions, such as lifting a weighted object.

A variety of figure toys and dolls are known in the art for simulating human characteristics. Such dolls include those capable of walking, talking, crying, wetting, eating, and the like. Dolls having articulated and movable torsos, heads, arms and legs enable a child to manipulate the doll's body and limbs so that the child can envision numerous play situations. It is well known to provide dolls of this type, with mechanisms which permit the doll to perform predetermined manipulations and movements such as walking. To the best of applicants' knowledge, mechanisms for causing a doll's arm to move, generally permit the entire arm to swing through a wide arc in one continuous sweep. Continuous efforts are being made to improve the existing state of the art by developing dolls which are even more life like or realistic than presently known.

Accordingly, one object of the present invention is to provide a new and improved figure toy construction having movable limbs.

Another object is to provide an improved doll having an articulated limb which is movable in response to manipulation of a mechanism within the doll.

A further object is to provide a new and improved apparatus for imparting movement to a doll's arm with respect to its body.

A still further object is to provide an apparatus for manually controlling the pivotal movement of a doll's arm in small increments, such arm being capable of lifting a weighted object.

Other objects and advantages will become apparent from a consideration of the following specification and accompanying drawings. Before proceeding with a detailed description of the invention however, a brief resume of it will be presented.

In general, the invention comprises a doll figure which includes a torso having a head movably connected thereto, a pair of articulated legs pivotally connected to the torso, and a pair of arms pivotally connected to the torso. An actuator, mounted in the torso, is operatively connected to one of the arms through a gear transmission so that pivotal and incremental movement from a first position to a second position, can be imparted to the arm when the actuator is activated. The arm and the transmission system are constructed so that loads of predetermined magnitude can be lifted by the arm.

The invention will best be understood by reference to the following drawings, wherein:

FIG. 5 is an enlarged partial side view, taken along line 5—5 of FIG. 3;

FIG. 7 is a sectional view taken along line 7—7 of FIG. 5;

FIG. 8 is an exploded perspective view depicting the apparatus for imparting relative movement to the doll's arm;

Figure 1:
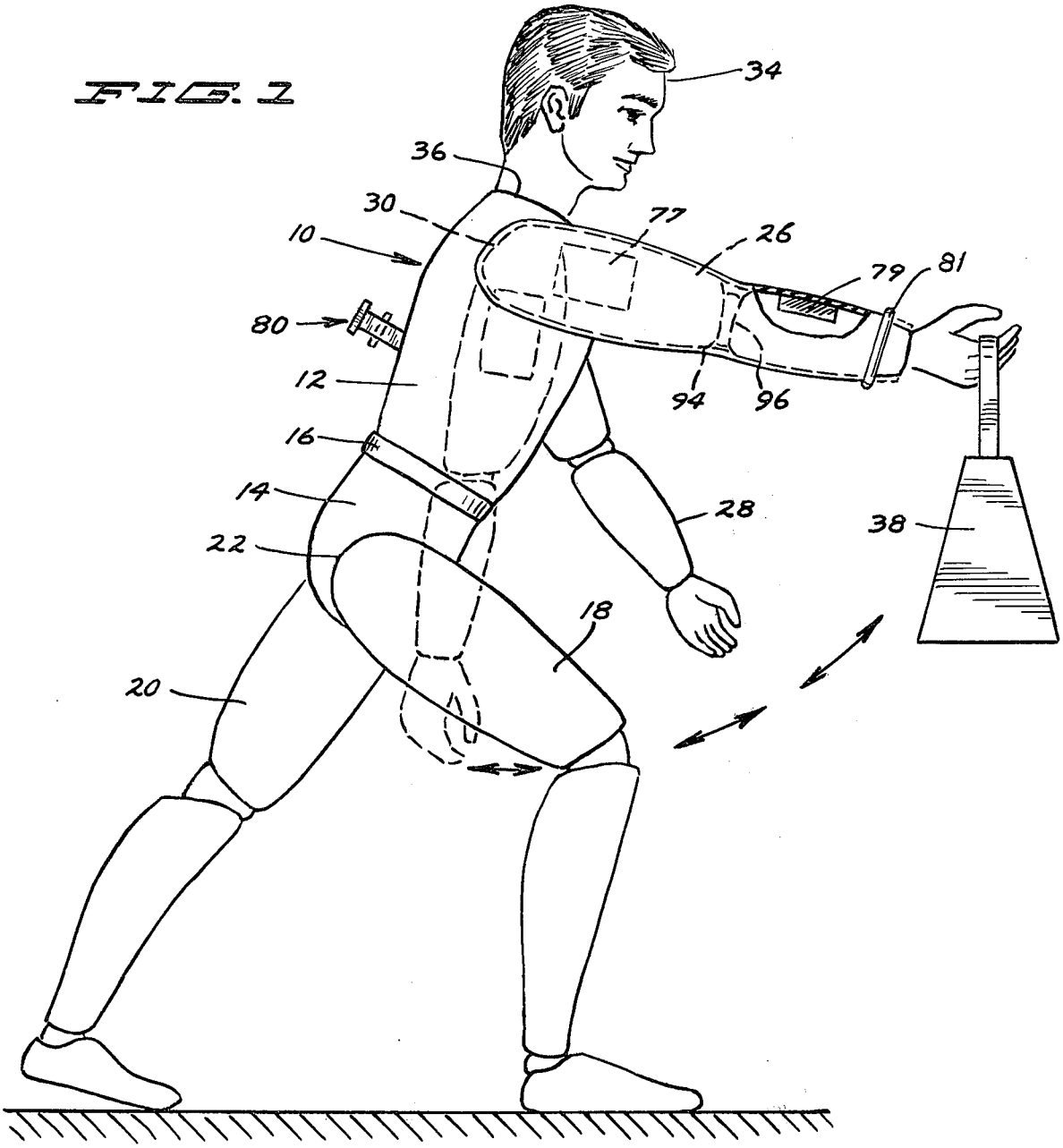
FIG. 1 is a side elevational view of an articulated doll figure which illustrates the doll as lifting a weighted object.

The figures illustrate an articulated doll 10 having the general configuration of a man. As depicted generally in FIGS. 1–3, the doll includes a hollow upper torso 12 comprised of a front portion 11 and a back portion 13 joined together by appropriate means, and a lower torso or hip portion 14. The upper and lower torsos are rotatably connected to each other by a waist joint, designated generally by numeral 16. A pair of jointed legs 18 and 20 are pivotally connected to the lower torso 14 to form hip joints 22 and 24 respectively, and a pair of jointed arms 26 and 28 are rotatably connected to the torso 14 to form shoulder joints 30 and 32 respectively. A head 34 is pivotally connected to the torso 14 to form a neck joint 36. As illustrated in FIG. 1, the doll 10 is shown as lifting a weighted object 38.

Figure 4:
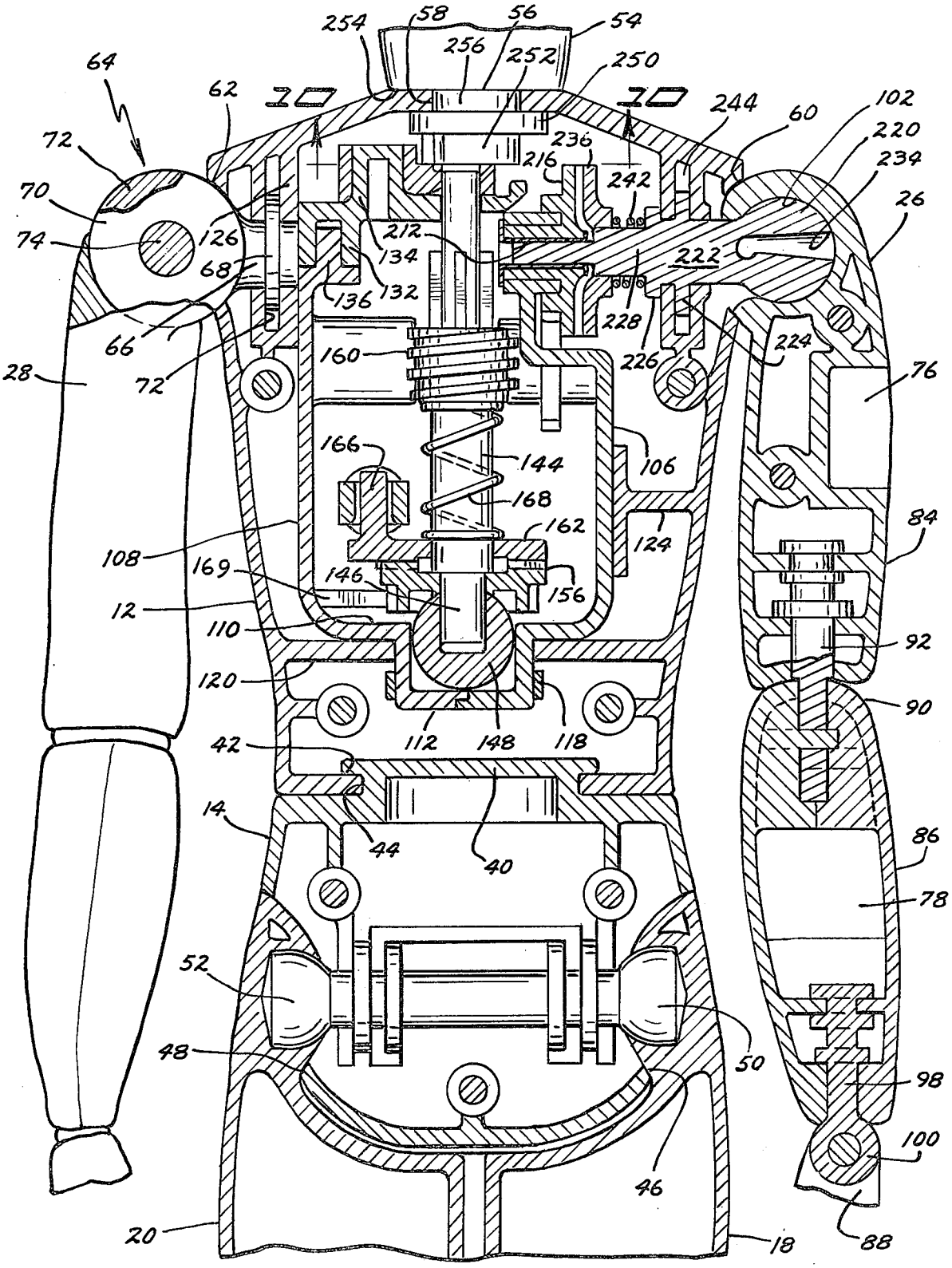
FIG. 4 is an enlarged rear view, in partial section, taken along line 4—4 of FIG. 2.
Figure 11:
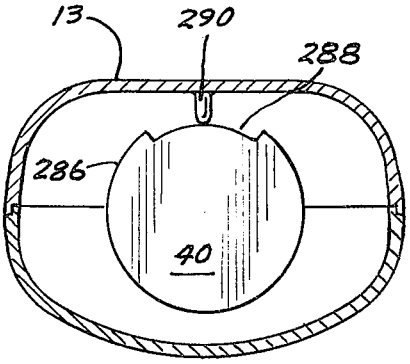
FIG. 11 is a sectional view taken along line 11—11 of FIG. 3.

As shown more fully in FIG. 4, the lower torso 14 is provided with a head member 40 having an annular recess 42, and it is rotatably secured to the upper torso 12 by positioning it in an aperture 44 formed in the lower portion of torso 12. Thus, the upper torso can be pivoted or swiveled about a vertical axis, as viewed for example in FIG. 4, relative to the lower torso 14 and legs 18 and 20. Under most circumstances, it is preferable to limit the relative rotational movement at the waist. Accordingly, the head member 40 includes a flange 286, which partially surrounds the head, so that a gap or space 288 is formed. A stop 290 formed on the back surface of the upper torso 13, cooperates with the gap 288 to limit the relative movement of the torsos with respect to each other. In this regard, note FIG. 11 as well. The lower torso is also provided with a pair of apertures 46 and 48 in the hip areas of the torso, which permits the legs 18 and 20 to be pivotally connected to knobs or heads 50 and 52 within the lower torso.

The doll's head 34, and more specifically the neck 54, is pivotally attached to the torso 12 by a cam member 56, which also serves as a mounting means; this member will be described more fully hereinafter. In general, the cam member 56 is retained within an aperture 58 formed in the upper end of the torso.

The upper torso 12 is provided with a pair of socket forming apertures 60 and 62 in the shoulder area of the torso, for permitting the arms 26 and 28 to be secured thereto. The left arm 28 is movably attached to the torso by a connector 64 which includes a stub shaft 66 having a radial flange 68 formed thereon, and a flattened circular tab 70. The connector 64 is positioned within the torso 12 by mounting the flange 68 in a bearing surface 72. The arm 28 is hingedly secured to the connector 64 by inserting the circular tab 70 within a slot 72 formed in the upper end of the arm, a crossbar or pin 74 retains the tab 70 within the slot, so that a frictional fit results. The left arm 28 can be pivoted about the axis of pin 74, as well as rotated about the axis of shaft 66 by manually grasping the arm and manipulating it, as desired.

The right arm 26 is movably secured to the torso in a different manner, so that its relative movement can be controlled by an apparatus which includes an externally projecting actuator pin or push button 80 and a transmission system designated generally by numeral 82 which operatively connects the pin 80 to the arm. In general, the arm 26 includes an upper arm 84, a lower or forearm 86 and a hand 88. Arms of this type are relatively conventional in construction, and will not be described in substantial detail. In general, the forearm 86 is movably secured to the upper arm 84 to form an elbow joint 90, by means of a member 92 which permits the forearm 86 to be pivoted or bent about an axis transverse to the longitudinal axis of the arm when in a straightened condition, as well as rotated about such longitudinal axis. If desired, appropriate stops or limits can be provided for limiting such relative movements. For example, as viewed in FIGS. 1 and 2, the edges 94 and 96 of the upper arm and the forearm respectively, effectively prevent the forearm from being pivoted beyond a prescribed point. In a like manner, the hand 88 is pivotally secured to a member 98 which is rotatably mounted in the lower portion of the forearm 86, to form a wrist joint 100. While not shown in detail, the left arm 28 can be constructed in a similar manner. The upper end of the upper arm 84 is provided with a generally spherical cavity 102, as a means for securing it to the torso to form a shoulder joint. In addition, a pair of cavities 76 and 78 are provided in the arm 26 for holding inserts 77 and 79 respectively. It is envisioned that such inserts might be simulated battery packs, or the like. Moreover, if desired, a flexible skin-like covering 81 made of rubber, plastic, or the like, might be provided which stretchably fits over the right arm, or any of the other appendages. As depicted in FIG. 1, such a covering helps maintain the inserts 77 and 79 in place, as well as to cover the joints. It can readily be rolled up so that the inserts are exposed.

Reference is now made to the transmission system 82 which transmits relative movement to the right arm 26. As viewed more fully in FIG. 8, the transmission system includes a gear box 104 having a pair of side walls 106 and 108, and a bottom wall 110. The bottom wall 110 includes a cylindrical compartment or cavity 112. A pair of male and female projections 114 and 116 respectively, are provided for joining the side walls together and maintaining them in spaced relationship. Appropriate means, such as an adhesive, help prevent the male and female projections from separating. In addition, a band 118 is forceably fit around the exterior of the compartment 112. The gear box is mounted within the torso 12 by means of support members 120, 122, 124, and 126.

A generally rectangularly shaped, horizontally oriented platform 130 is affixed to the top of the gear box 104. The platform 130 is provided with three cylindrical hubs 131, 132 and 133 which project downwardly from one of its surfaces, and a cylindrical stub shaft 134 which projects upwardly from its other surface. The platform 130 is mounted on the gear box by positioning the hubs 131, 132 and 133 on a pair of cylindrical projections 135 and 136 which project upwardly from the wall 108, and a single projection 137 which projects upwardly from the wall 106. An elongated opening 138 is formed in the platform surface, and a stop 140 is mounted on a flexible leaf 142.

A vertically oriented shaft 144 is rotatably mounted within the gear box 104. A first or lower end 146 of the shaft is positioned within a ball member 148, and it is keyed thereto so that rotation of the shaft about a first axis, i.e., its longitudinal axis, imparts relative movement to the ball as well. In this regard, note that the lower end portion 146 is provided with a flattened surface 150, which corresponds in size and shape to a generally hemispherical opening 152 in the ball 148. The ball 148 is mounted within the cylindrical compartment 112. The shaft 144 is also movable about a second axis which is normal to the first axis.

The second or upper end 154 of the shaft 144 projects through the elongated opening 138 in the platform 130. A spring-loaded ratchet mechanism 155 operatively connects the actuator pin 80 to the shaft 144. The mechanism 155 includes a ratchet drive gear 162 and a ratchet driven gear 156. The ratchet gear 156 includes an integrally formed spur gear 157, and it is keyed to the shaft 144 proximate the ball 148 (in the same manner as the ball 148), and it is provided with a plurality of inclined teeth 158 on one surface. The ratchet drive gear 162 is rotatably mounted on the shaft, and it is provided with a plurality of inclined teeth 164 on one surface, which are adapted to engage the teeth 158 on the driven gear 156. A cylindrical stub shaft or post 166 projects from the other surface of the gear 162. A worm 160 is also keyed to the shaft 144 proximate the upper portion of the shaft. A spring 168 mounted on the shaft 144 and interposed between the worm 160 and the drive gear 162, urges the ratchet gears together. A pair of pawls 167 and 169 are secured at one end to the side walls 106 and 108 respectively, and they engage the teeth on the gear 157. Rotational movement of the drive gear 162 in one direction imparts similar movement to the driven gear 156, whereas rotational movement of the gear 162 in the opposite direction, does not impart a similar movement to the gear 156, due to the ratchet/pawl construction.

The actuator pin 80 includes an elongated actuator lever 170 which projects transversely with respect to the vertical shaft 144. As viewed more readily in FIG. 5, a tapered first end portion 172 of the lever projects through an aperture 174 in the back surface of the doll, and a gripper 176 is forceably secured to the end 172. The other end portion 178 of the lever is slidably engaged in a tubular housing 180. An integral hub 182 is interposed between the ends 172 and 178 of the lever, and it is provided with an elongated opening 184 which is slightly larger than the stub shaft 166. A shoulder 188 is formed at the point where the second end portion 178 is joined to the hub 182. A ridge or abutment 186 is formed proximate the end portion 172. A compression spring 190 surrounds a portion of the lever, and it is interposed between the end of the housing 180 and the shoulder 188 so that it urges the actuator pin 80 out of the doll's body. In assembled relationship, the lever 170, and more specifically, the hub 182, engages the shaft 166, and the end portion 178 is slidably retained within the housing 180.

A gear train 192 is provided for transmitting rotational movement of the shaft 144 to the right arm 26. A shaft 194 is rotatably mounted at its ends in the side walls 106 and 108 so that its longitudinal axis is normal to that of shaft 144. A worm gear 196 is fixedly secured to the shaft by appropriate means, and it is aligned so that it is engageable by the worm 160. The worm gear 196 is integrally connected to a cylindrical extension 196 which includes a pair of tabs or projections 200 on opposite sides of the shaft. A spur gear 202 is also rotatably mounted on the shaft 194 and it includes a cylindrical extension 204 having a pair of detents or slots 206. In assembled condition, the worm gear 196 and the spur gear 202 are mounted adjacent to each other so that the projections 200 engage the detents 206 and they are drivingly connected together.

A compound gear 210 is rotatably mounted in the side wall 106 by means of a rivet or eyelet 208, having a bore 212 therethrough. The compound gear 210 includes a spur gear 214 and a ratchet drive plate 216 having a plurality of inclined teeth 218 thereon. A slip clutch 215, which includes the drive plate 216 and a ratchet driven plate 236, operatively connects the arm 26 to the gear train 192, and more specifically to the worm gear 196 and shaft 144. The gear 210 is positioned so that the spur gear 214 meshes with, and is driven by, the spur gear 202.

A shoulder ball joint is operatively connected to the compound gear 210 so that it can be moved in response to rotational movement of the gear 210. The shoulder joint includes a rounded ball portion 220 integrally formed on a shaft 222. The shaft 222 is provided with a pair of spaced apart radial flanges 224 and 226, a generally noncylindrical portion 228, and a projecting pin 230. The ball portion 220 includes a pair of cylindrical projections (or crossbar) 232 on opposite sides of the ball, and it is provided with a slit 234 which renders the ball somewhat resilient or flexible. As shown in FIG. 4, the right arm 26 is connected to the torso by inserting the ball portion 220 into the spherical cavity 102 in the bulbous upper arm 84. Since the ball 220 is somewhat flexible or resilient, it can be forced or snapped into the cavity 102 and retained therein.

The ratchet driven plate 236 is provided with a generally rectangular opening 240 and it is mounted on the shaft portion 228. A plurality of inclined teeth 238 are provided on one surface of the plate, and they mesh with the teeth 218 on drive plate 216. A compression spring 242 is positioned on the shaft so that it is interposed between the radial flange 226 and the ratchet plate 236. In assembled condition, the shoulder ball joint is positioned within the aperture 60 so that the radial flange 224 is retained within an annular channel 244, see FIG. 4. As shown, the shaft pin 230 is positioned within the bore 212 of rivet 208, and the ratchet driven plate 236 is urged against the ratchet drive plate 216 by the spring 242 so that the teeth 238 are engaged by the teeth 218. Thus, relative movement is imparted to the ratchet plate 236 when the compound gear 210 is caused to rotate. It should be realized that since the ratchet plates 216 and 236 form the slip clutch 215, relative movement is imparted to the arm in only a single direction by the transmission system 82 as the actuator pin 80 is actuated. If however, an excessive force or load is exerted against the arm 26, the slip clutch 215 will permit the arm to be moved in a direction counter to its normal movement.

Figure 6:
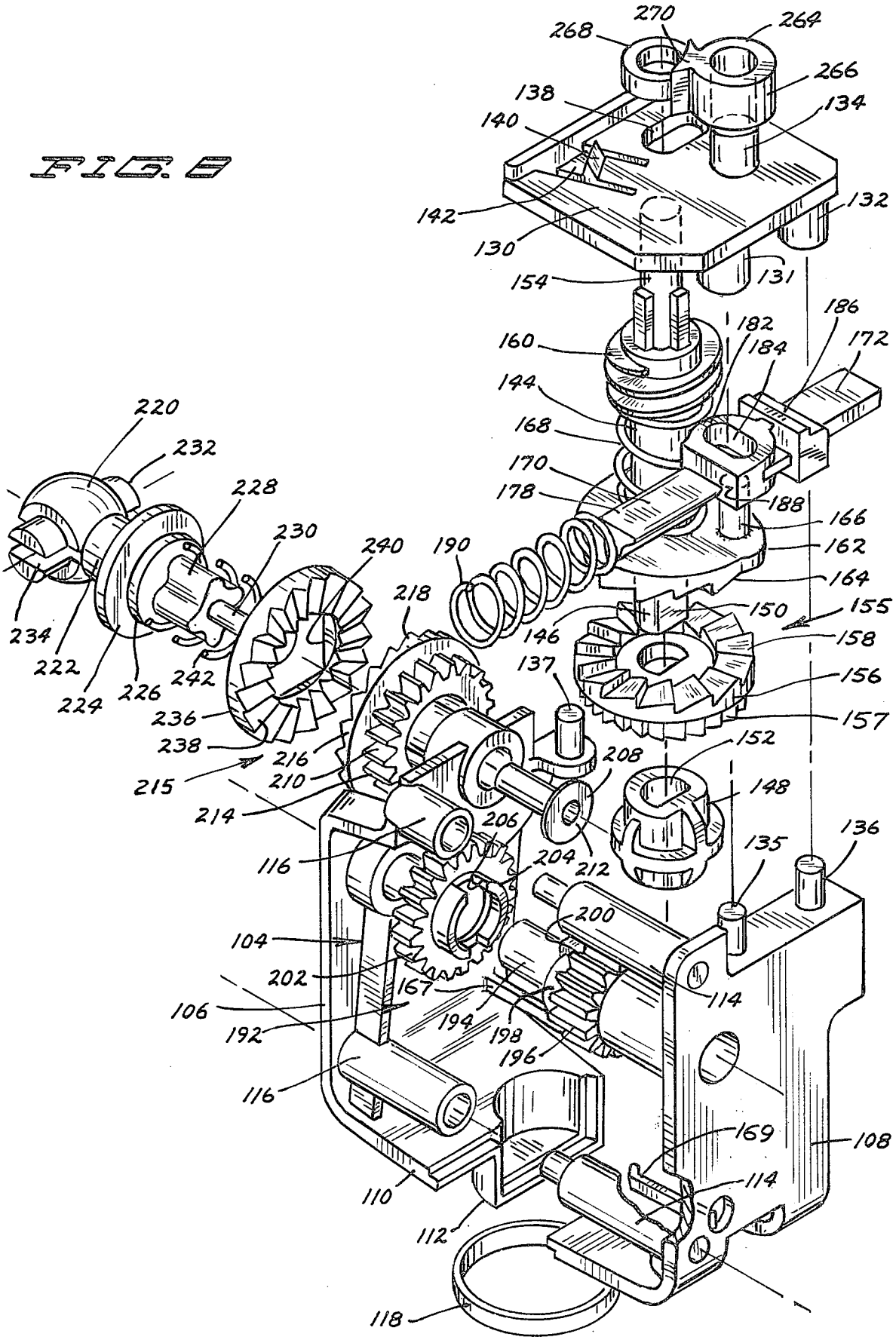
FIG. 6 is a sectional view taken along line 6—6 of FIG. 5.

At this point, it might be pointed out that both surfaces of the teeth 218 and 238 of the slip clutch 215, are inclined or slanted, whereas only a single surface of the teeth 158 and 164 of the ratchet mechanism 155 are inclined or slanted. In other words, as shown for example in FIG. 5, one surface of the teeth 158 and 164 is substantially vertical, while the other surface has a pitch ranging from about 15°–30° as measured from a horizontal plane; this permits a more positive engagement between the teeth when the ratchet mechanism 155 is actuated. As shown in FIG. 6, the teeth 218 and 238 on the other hand, have two slanted or inclined surfaces; this permits the slip clutch 215 to function. The pitch on the teeth 218 and 238 is such that the clutch functions or slips in a direction counter to its normal movement, only if an excessive load or force is exerted against the arm. In other words, as depicted in FIG. 8, as the drive plate 216 rotates in a clockwise direction, the driven plate 238 will also rotate in a clockwise direction, under normal operating conditions. If an oppositely directed force of sufficient magnitude is exerted against the arm 26, the driven plate 238 will slip or move in a counterclockwise direction with respect to the drive plate 216.

Figure 10:
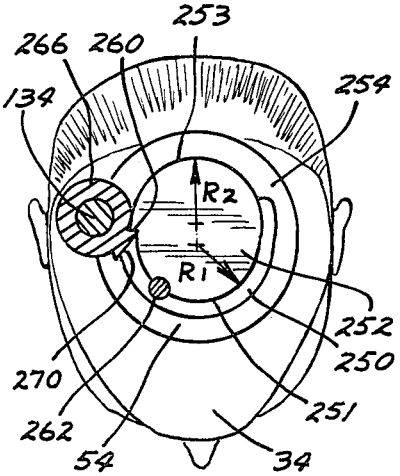
FIG. 10 is a sectional view taken along line 10—10 of FIG. 4.

Reference is now made to the head 34 and to the manner in which it is connected to the torso 12. As viewed in FIG. 10, the cam member 56 includes a radial flange 250 and an integral cam surface 252 having edges 251 and 253. It should be observed that the flange 250 only partially surrounds the member 56, so that a space or gap of approximately 100°–120° results. The flange 250 and the lower surface 254 of the neck form an annular channel 256 which fits within the aperture 58, note also FIGS. 4 and 5. A stop 258 formed on the back portion of the torso 12 proximate the aperture 58, cooperates with the gap to limit the pivotal movement of the head 34 about a vertical axis. As shown in FIG. 10, the cam surface 252 has a somewhat oval shape, in that the radius $R_1$ has a slightly smaller dimension than the radius $R_2$, and a shoulder 260 is formed where the two radii intersect. A pin 262 is mounted in the radial flange 250 so that it projects downwardly toward the platform 130. The projecting end of the pin 262 contacts the flexible leaf 142; as the head 34 is pivoted or turned, the pin 262 is engaged by the stop 140 on the leaf.

A cam lever 264 is positioned on the top surface of the platform 130 proximate the second end 154 of the shaft, and it is adapted to be engaged by the cam surface 252. The function of the lever 264 is to move the shaft 144 and worm 160, toward and away from, the worm gear 196. The cam lever includes a pair of integrally connected collars 266 and 268, and a cam surface 270. The collar 266 is positioned on the stub shaft 134, and the collar 268 is positioned on the end 154 of the shaft 144. Thus, the cam lever effectively links the shafts 134 and 144 together.

An elongated lens holder 272 is mounted in the head 34 by means of support members 274 and 276 so that it is aligned with an aperture 278 which forms an eye of the doll, and an aperture 280 in the back of the doll's head. A wide angle lens or a magnifying lens 282 is retained at one end of the holder 272 so that it is proximate the aperture 278, and an eye lens 284 is retained by the second end of the holder so that it is positioned within the doll's head.

Figure 2:
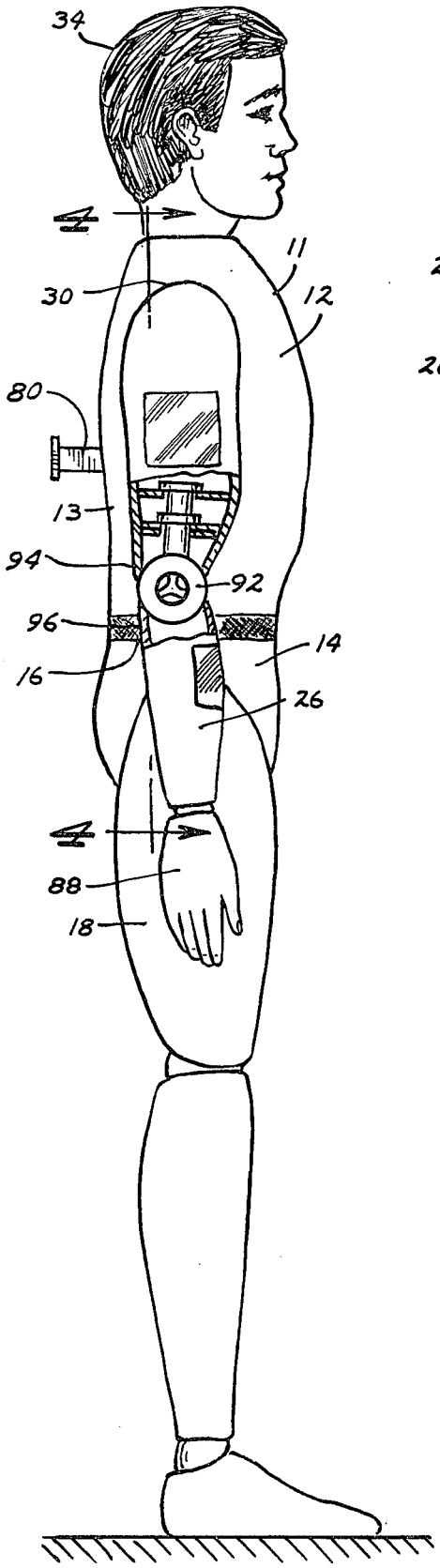
FIG. 2 is a side elevational view illustrating the doll in a standing position.
Figure 3:
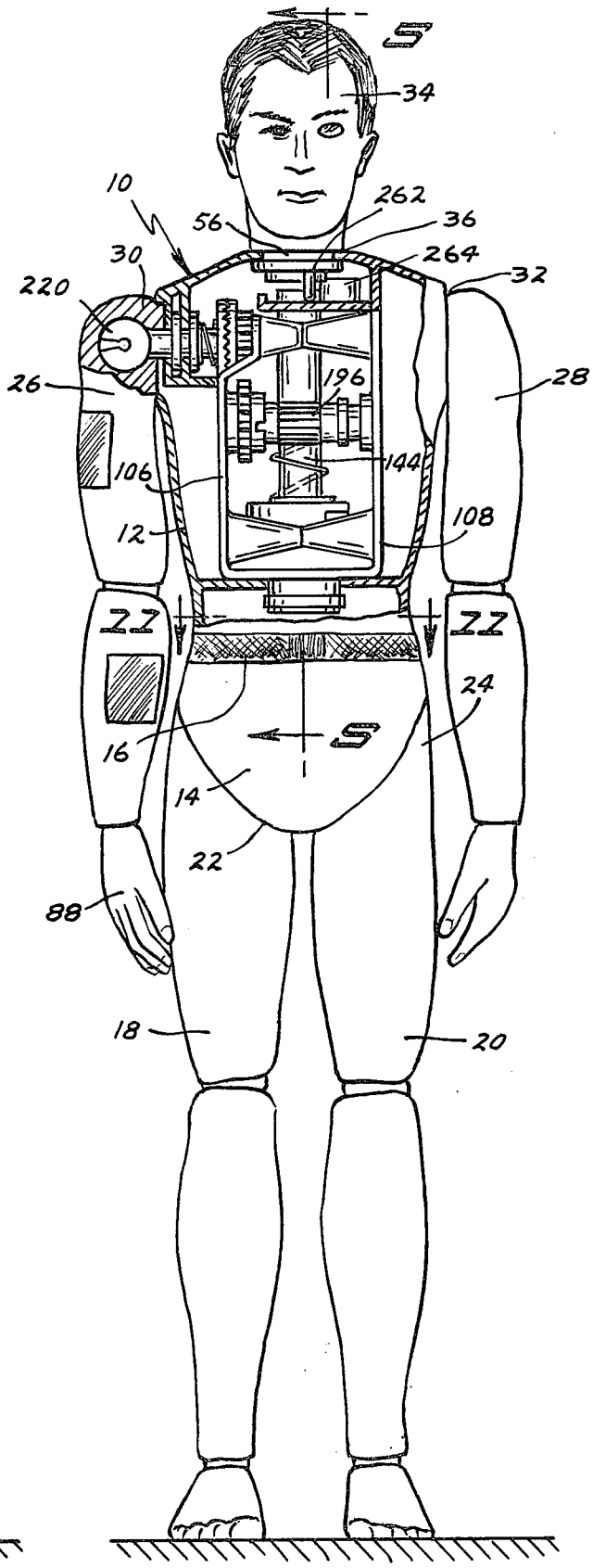
FIG. 3 is a front elevational view of the doll shown in FIG. 2, in partial section.

During play, a child can manipulate the articulated doll so that it assumes a variety of different positions. FIGS. 1 and 2 for example, illustrate the doll 10 in two different stances. The feature which promotes the most interest and excitement, is the doll's capability of moving its arm 26 from a first position, in increments rather than one continuous sweep, to a second position. Moreover, it has the capability of lifting a weighted object placed in its right hand, in a deliberate and incremental manner. At this point, it should be recognized that although the drawings illustrate the right arm 26 as being movable by manipulating the actuator pin 80, the actuator pin 80 and the transmission system 82 might just as readily be operatively connected to the left arm 28. Either arm is freely movable relative to the torso 12, due to its pivotal mounting at the shoulders, as well as at the elbows and wrists. Thus, the arms can be positioned in numerous configurations to simulate human actions.

In operation, the transmission system 82 is placed in gear, and taken out of gear, by manually rotating the head 34. Placing the transmission in gear will be described first. By rotating the head 34 in a clockwise direction about a vertical axis, as viewed in FIG. 3, the head will be directed toward the right arm 26. As the head is rotated, the pin 262 passes over the stop 140 on the flexible leaf 142, and is retained in that position by the stop. At the same time, the shoulder 260 formed by the edges 251 and 253 of the cam surface 252, engages the cam surface 270 of the cam lever 264, and causes the cam lever to pivot about the axis of shaft 134. As the collar 268 moves toward the front of the doll, the shaft 144 pivots about the second axis; in other words, the top end 154 of the shaft 144 moves forwardly within the elongated opening 138 so that the worm 160 engages the worm gear 196. Since the arm 26 is operatively connected to the shaft 144 by the gear train, it can no longer be rotated in a clockwise direction, as viewed in FIG. 1, unless the slip clutch 215 permits such movement due to an excessive force being applied against the arm.

By pushing against the actuator pin 80, and more particularly the gripper 172, the actuator lever 170 is forced toward the front surface of the doll, against the biasing action of the spring 190, and the transmission 82 is activated. In this regard, refer also to FIG. 8. Since the lever 170 is linked to the post 166, the ratchet drive gear 162 is caused to rotate in a clockwise direction, when viewed from the top in FIG. 8. As the gear 162 rotates, the inclined teeth 164 engage the inclined teeth 158 on the ratchet drive gear 156, thus causing the gear 156, as well as the shaft 144 and the worm 160, to rotate about the first axis. The spring 168 exerts a biasing action against the drive gear 162, thus urging it against the driven gear 156. Rotational movement of the worm 160 drives the worm gear 196 and the spur gear 202, thus causing them to rotate in a counterclockwise direction, about the axis of shaft 194. As the gear 202 rotates, it imparts rotational movement in a clockwise direction, to the compound gear 210 and the slip clutch 215. As the ratchet drive plate 216 rotates, the inclined teeth 218 engage the inclined teeth 238 on the ratchet driven plate 236, and the spring 242 urges them together. As the ratchet plate 236 rotates, it engages the shaft 222, and more specifically the portion 228, and causes it to also rotate in a clockwise direction, thus causing the ball portion 220 to be rotated and the arm 26 to be raised.

When the gripper 172 is released, i.e., the pushing force is removed, the spring 190 urges the lever 170 backwards and the gear 162 rotates in a counterclockwise direction, against the biasing action of the spring 168. In this regard, the force exerted by the spring 190, is greater than the force exerted by the spring 168; as a result, the gear 162 rotates in a counter direction and the actuator 80 is forced out of the doll's body. The gear 156 on the other hand, remains stationary because the pawls 167 and 169 engage the teeth on the gear 157. The inclined nature of the teeth on both gears permits the gear 162 to rotate relative to the gear 156, so that the ratchet teeth on the gear 162 engage a different set of teeth on the gear 156. Continued manipulation of the actuator pin 80 causes the arm to be raised incrementally, that is, a step at a time because one or more teeth are by-passed depending upon the length of the stroke of the actuator pin 80. Moreover, the meshing teeth on the slip clutch 215 effectively prevent the arm from being lowered while the actuator 80 is being manipulated, unless an excessive force is exerted against the arm. Thus, a small load of predetermined magnitude can be grasped, or placed in, the hand, and raised in a slow deliberate manner.

Figure 9:
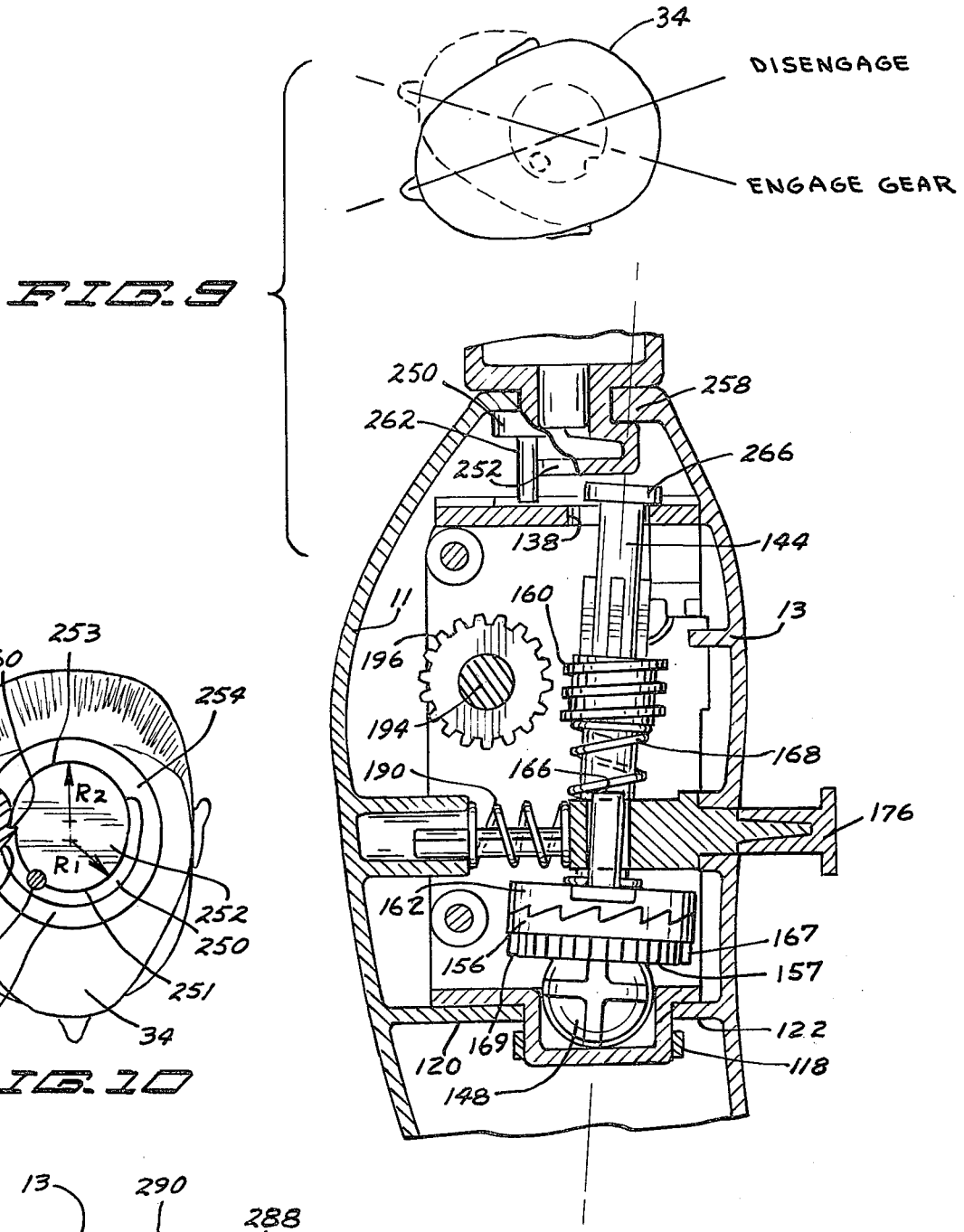
FIG. 9 is a view similar to FIG. 5, but showing the apparatus in a different operating condition.

After the arm 26 has been raised or elevated to its desired position, the transmission system 82 can be released or taken out of gear so that the arm 26 can be lowered. This is accomplished by merely turning the head 34 in a counterclockwise direction (as viewed in FIG. 3) so that it is directed toward the left arm 28. As the head is moved in this manner, the pin 262 passes over the stop 140 and the edge 251 of the cam surface 252, wipes against the cam surface 270 of cam lever 264 so as to cause the cam lever 264 to pivot about the axis of the stub shaft 134. As this occurs, the shaft 144 is moved or oscillated therein toward the back surface of the doll. In other words, the shaft 144 rocks or swivels about the second axis, and more particularly, the ball surface 148, and the worm 160 is disengaged from the worm gear 196 so that the gear train 192 and the arm 28 are freely movable in either direction, such arm being rotatable about the axis of shaft 222. In this regard, note FIG. 9 as well.

In certain instances, it might be desirable to change the attitude of the arm 26, even though the apparatus is in gear, i.e., the worm 160 engages the worm gear 196. Inclusion of the spring loaded slip clutch 215 permits the arm 26 to be raised as viewed in FIG. 1, without damaging the components of the transmission system 82. In other words, the spring 242 permits the inclined teeth 238 on the driven plate 236 to slip by the inclined teeth 218 or the drive plate 216. Movement of the arm 26 in a counter direction on the other hand, is effectively prevented, unless of course, an excessive force is applied to the arm.

Figure 12:
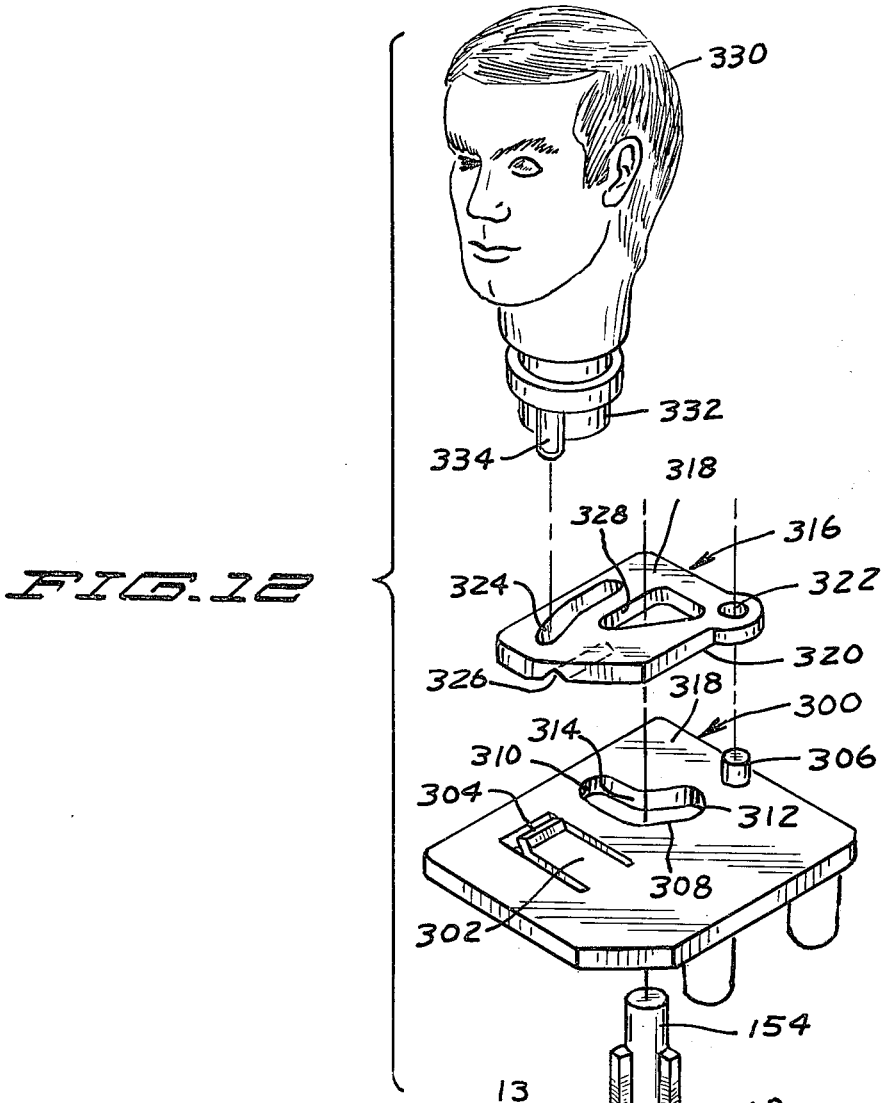
FIG. 12 is an exploded perspective view illustrating another embodiment of the invention.
Figure 13:
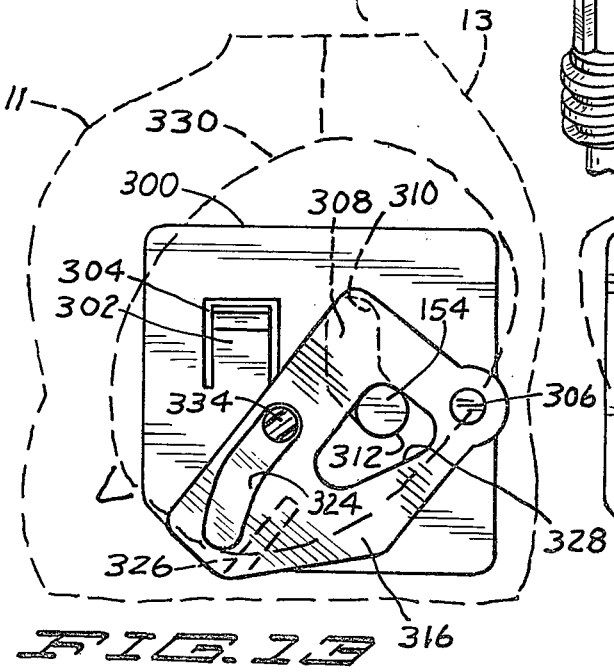
FIG. 13 is a plan view illustrating the components shown in FIG. 12, when the system is out of gear.
Figure 14:
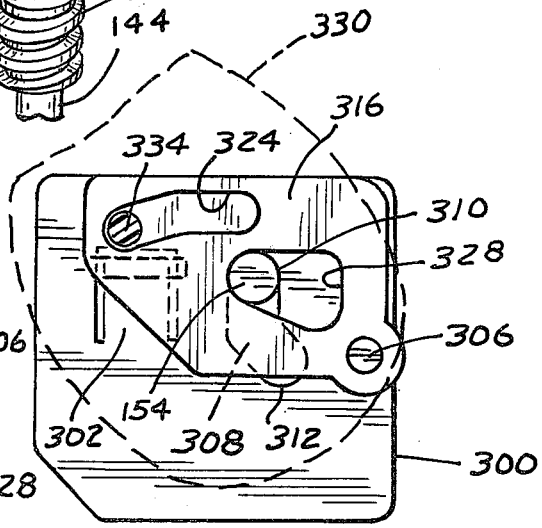
FIG. 14 is a view similar to FIG. 13, but illustrating the components when the system is in gear.

Reference is now made to FIGS. 12–14. These figures represent another embodiment of the invention which is quite similar to that depicted in FIGS. 1–11, except that a somewhat different construction is provided for placing the transmission in gear, and taking it out of gear. FIG. 12 is similar to FIG. 8 in that it shows the upper end 154 of the shaft 144 having the worm 160 secured thereto.

A horizontally oriented platform 300 is affixed to the top of a gear box (not shown) in the same manner as the platform 130 described hereinbefore. A flexible leaf 302 having a stop 304 mounted thereon, is formed in the platform, and a post 306 projects upwardly from the top surface, proximate one of the edges of the platform. A somewhat V-shaped opening 308 is formed in the platform 300 proximate the post 306, and it includes end portions 310 and 312. As shown, the point 314 of the opening is somewhat rounded.

A cam plate 316 is positioned on the top surface of the platform 300, and it includes a top surface 318 and a bottom surface 320. A bore 322 is formed at one corner of the plate, and the plate is pivotally connected to the platform by positioning the post 306 in the bore 322, so that the platform is pivotable about the axis of the post 306. An elongated groove or trough 324 is formed in the top surface 318, and as viewed more specifically in FIG. 13, it has a slightly curved or arcuate shape. If desired, the groove 324 could extend all the way through the plate 316 to form a slot. A small V-shaped groove 326 is formed in the bottom surface 320 of the cam plate. An irregularly-shaped opening 328 is formed in the cam plate 316, so that it is interposed between the bore 322 and the groove 324. As seen in either FIG. 13 or FIG. 14, the opening 328 is somewhat triangularly shaped. In assembled condition, the end 154 of shaft 144 projects through the V-shaped opening in the platform 300, as well as the opening 328 in the cam plate 316, thus, effectively linking the platform and the plate together. In assembled condition, the V-shaped groove 326 is positioned proximate the stop 304 on the leaf 302.

The head 330 is substantially the same as the head 34 described above. It is provided with a cam member 332 which includes a downwardly projecting pin 334. When the head 330 is mounted in the doll's torso, the pin engages the arcuate groove 324.

In operation, the transmission is placed in gear, or taken out of gear, by rotating the head 330 about a vertical axis. Particular reference will be made to FIGS. 13 and 14 in describing the operation. As viewed in these figures, the left edge of the sheet represents the front surface of the doll, and the right edge represents the rear surface of the doll. As the head is rotated to the right (in a clockwise direction as viewed in FIG. 14), the pin 334 engages the arcuate groove 324 in the cam plate 316 and causes the cam plate to pivot in a clockwise direction about the axis of post 306 until the stop 304 on the leaf 302 engages the groove 322. The components are retained in this condition as long as the head 330 is not moved. Manipulation of the actuator pin 80 causes the right arm to be incrementally raised. FIG. 14 illustrates the orientation of the platform 300 and the cam plate 316 relative to each other, when the system is in gear. It should be noted that the shaft end 154 is positioned proximate the end 310 of the opening 308, and as such, the worm 160 engages the worm gear, as described hereinbefore.

The transmission is taken out of gear by rotating the head 330 in a counterclockwise direction (to the left as viewed in FIG. 13). As the head rotates, the pin 334 moves within the arcuate groove 324, and causes the cam plate 316 to pivot about the axis of post 306 in a counterclockwise direction. Sufficient force must of course, be exerted to cause the stop 304 to slip out of the groove 326. As the cam plate 316 pivots, the shaft 144 is pivoted about the ball 148 so that the worm 160 is separated from the worm gear 196. More specifically, the shaft end 154 is caused to move so that it is positioned proximate the end 312 of the opening 308. It might be pointed out that the shaft 144 moves along a generally diagonal line as the cam plate 316 is pivoted, rather than in a straight forward and backward direction as in te first embodiment. The result is the same however, in that the worm 160 is moved toward and away from the worm gear 196.

In the above description and attached drawings, a disclosure of the principles of the invention is presented, together with some of the specific embodiments by which the invention might be carried out.

The embodiment of the invention in which an exclusive property or privilege is claimed are defined as follows:

1. An articulated toy figure comprising a torso, a head, means for movably connecting said head to the upper portion of said torso, a pair of legs, means for connecting said legs to the lower portion of said torso, a pair of articulated arms, means for connecting said arms to the torso so that they are movable with respect thereto at respective shoulder connections, means for imparting incremental movement to one of said arms relative to said torso from a first position to a second position, said movement imparting means including a transmission system mounted within said torso, said transmission system being operatively connected to said one arm, means for activating said transmission system, means for placing said transmission system in gear whereby rotational movement is imparted to said one arm in increments in response to activation of said transmission system, said means for placing said transmission system in gear permitting said transmission system to be taken out of gear so that said one arm is freely movable.

2. The combination of claim 1 wherein relative rotational movement of said one arm is limited to a single direction when the transmission system is in gear.

3. The combination of claim 2 wherein a slip clutch is provided which permits said one arm to be rotated in either direction when the transmission system is in gear.

4. The combination of claim 1 wherein the transmission system includes a gear box, an elongated shaft mounted within said gear box so that it is rotatable about a first axis, means for permitting said shaft to be pivoted about a second axis which is normal to said first axis, a gear train operatively connected to the one arm, and means on said shaft for engaging said gear train as said shaft is pivoted from a first position to a second position about said second axis, and causing said gear train to be activated when said shaft is rotated about said first axis, said means for placing said transmission system in gear being operatively connected to said shaft.

5. The combination of claim 4 wherein the means for engaging the gear train includes a worm mounted on said shaft, said worm adapted to engage a worm gear forming a part of the gear train.

6. The combination of claim 4 wherein a first end of said shaft is mounted in a ball member, means for retaining said ball member within the gear box so that said shaft can be moved in more than one direction.

7. The combination of claim 4 wherein the means for placing said transmission system in gear is positioned proximate a second end of the shaft, said last-mentioned means causing said shaft to be pivoted about said second axis.

8. The combination of claim 7 wherein said last-mentioned means includes a cam member attached to the doll's head, means for operatively connecting said cam member to the second end of said shaft whereby rotational movement of the head imparts movement to said shaft about said second axis.

9. The combination of claim 8 wherein means are provided for limiting the rotational movement of the doll's head.

10. The combination of claim 8 which includes a cam lever, means for pivotally connecting a first end of said cam lever to the top surface of the gear box, means for operatively connecting a second end of said cam lever to the elongated shaft, said cam member engaging a portion of said cam lever and causing it to pivot about said first end as the head is rotated.

11. The combination of claim 10 wherein the cam lever includes a cam surface, said cam member including means for engaging said cam surface as the doll's head is rotated.

12. The combination of claim 8 which includes a cam plate, means for pivotally connecting said plate to the top surface of the gear box, said top surface having an elongated opening therein, said cam plate being provided with an opening which is juxtaposed over the opening in said top surface, said elongated shaft projecting through said openings thereby linking said plate and said top surface together, said cam member including means for engaging the cam plate and causing said plate to pivot as the head is turned, relative movement of said head and plate causing the shaft to pivot about the second axis.

13. The combination of claim 12 wherein said cam plate includes an arcuate groove on its top surface, and the cam member includes a projecting pin, the projecting end of said pin being retained within said groove.

14. The combination of claim 12 wherein the top surface includes a flexible leaf with a stop thereon, and the cam plate includes a groove in its bottom surface, said groove being positioned proximate said stop and adapted to be engaged thereby as the cam plate is pivoted.

15. The combination of claim 8 wherein a platform is secured to the top of the gear box, said platform includes a flexible leaf with a stop thereon, said cam member includes a pin projecting therefrom which is positioned relative to said leaf so that it is engaged by the stop as the doll's head is rotated.

16. The combination of claim 1 wherein the means for activating the transmission system includes an elongated lever movably positioned within the torso so that one end projects through an opening in said torso, and a ratchet mechanism is provided for operatively connecting said lever to the elongated shaft, reciprocal movement of said lever imparting rotational movement to said shaft in a single direction.

17. The combination of claim 4 wherein the gear train includes a spring-loaded slip clutch, said clutch including a first ratchet plate which is operatively connected to the elongated shaft and a second ratchet plate which is operatively connected to the one arm, said slip clutch permitting said one arm to be moved in either direction when the transmission system is in gear.

18. The combination of claim 17 in which means are provided for permitting the attitude of the one arm to be adjusted when the transmission system is in gear.

19. The combination of claim 1 in which the doll's head is provided with a first aperture in one of the doll's eyes and a second aperture in the rear surface of said head, a lens holder is mounted within said head, an optical lens is mounted in said holder proximate the eye aperture, and an eye lens is positioned within said holder, remote from the optical lens.

20. The combination of claim 1 in which a flexible skin-like covering is provided which stretchably fits over at least one of the doll's appendages.

* * * * *